US005804135A

United States Patent [19]

Freudenberg et al.

[11] Patent Number: 5,804,135

[45] Date of Patent: Sep. 8, 1998

[54] GASSING AGITATOR FOR LIGHT METAL MELTS

[75] Inventors: Bernhard Freudenberg, Coburg; Felix Hellmuth, Staffelstein, both of Germany

[73] Assignee: Bayer Aktiengesellschaft, Leverkusen, Germany

[21] Appl. No.: 727,873

[22] Filed: Oct. 9, 1996

[30] Foreign Application Priority Data

Oct. 16, 1995 [DE] Germany ..... 195 39 621.9

[51] Int. Cl.[6] ..... C21C 7/00

[52] U.S. Cl. ..... 266/217; 266/235

[58] Field of Search ..... 266/235, 225, 266/216, 217; 222/603

[56] References Cited

U.S. PATENT DOCUMENTS

| | | | |
|---|---|---|---|
| 384,628 | 6/1888 | Johnson | 266/235 |
| 3,861,660 | 1/1975 | Ammann et al. | 266/235 |
| 3,881,709 | 5/1975 | Steen | 266/235 |
| 4,426,068 | 1/1984 | Gimond et al. | 266/235 |

FOREIGN PATENT DOCUMENTS

| | | |
|---|---|---|
| 0396267 | 11/1990 | European Pat. Off. . |
| 1926241 | 11/1970 | Germany . |
| 2333029 | 12/1973 | Germany . |
| 07048635 | 2/1995 | Japan . |

OTHER PUBLICATIONS

W. Schneider, "Reinigung von Aluminiumschmelzen", in DE–Z Giesserei 81, Nr. 14, pp. 478–483, (Dec. 1994).

*Primary Examiner*—Scott Kastler
*Attorney, Agent, or Firm*—Sprung Kramer Schaefer & Briscoe

[57] ABSTRACT

A gassing agitator for light metal melts made of thermal shock-resistant ceramic is described which consists of minimally machined ceramic tubes that are connected to one another using the insert and lock technique.

2 Claims, 3 Drawing Sheets

GASSING AGITATOR FOR LIGHT METAL MELTS

The present invention relates to a novel gassing agitator for light metal melts.

According to the prior art, in order to clean metal melts, particularly aluminum and aluminum alloys, finely distributed gases are blown into the melt. Thus, with liquid aluminum, there is a need to remove the dissolved oxygen which otherwise would lead to pores in aluminum castings, such as vehicle wheel rims, which on the one hand can reduce the stability of the casting and on the other hand are visually undesirable on the surface of the casting. The oxygen and fine solid particles are removed by blowing argon, nitrogen or chlorine into the melt. The blown-in rising gas bubbles remove the oxygen via dissolution processes or, in the case of chlorine, via chemical bonding processes. The prior art procedure consists of stirring the melt with so-called impellers and at the same time distributing the gas. The impellers generally consist of an approximately 1,000 mm long graphite tube, to the bottom of which is fixed a plate with radial holes which open into the graphite tube. The graphite tube and plate can be connected by means of a trapezoidal thread, for example, on account of the easy workability of the graphite. The service life of such graphite impellers is just a few weeks. Furthermore, there is a risk that graphite dust or graphite particles will be incorporated into the castings produced from the melt.

An object of the present invention is to overcome the disadvantages and risks associated with the use of graphite impellers.

The invention also has the object of making available gassing agitators for light metal melts made of thermal shock-resistant ceramic, e.g. based on SiC, $Si_3N_4$, $Si_xAl_yO_zN$ (Sialon) and/or aluminum titanate.

Although such thermal shock-resistant ceramics have already frequently been used in the context of light metal melt metallurgy in the form of simple mechanical structures such as tubes, e.g. as melt lifters, and their suitability for use in light metal melts is thus proven, mechanically complicated components made of ceramic have, in the past, not been recommended on account of the prohibitively high machining cost.

Accordingly, an object of the present invention is also to make available a ceramic gassing agitator that can be produced with minimal mechanical machining costs. In particular, the machining cost after sintering is to be kept to a minimum.

It was found that a gassing agitator made of ceramic tubes can be successfully produced using the insert and lock technique, in which only a few surfaces have to be machined to fit after sintering.

The objects of the present invention are realized by a novel gassing agitator for light metal melts having the following features:

a) a first ceramic tube (the agitator shaft) has, at one end, one or more opposite offset holes transversely to the tube axis;

b) one or more ceramic tubes (the agitator arms) with an external diameter fitting the transverse holes of the first tube have a hole centrally arranged transversely to the axis;

c) a second tube is passed through each of the transverse holes of the first tube so that the central transverse hole of the second tube communicates with the inside of the first tube; and d) the second tubes are fixed in the transverse holes of the first tubes by mechanical locking elements to prevent axial displacement;

e) at least the second tube arranged at the outermost end of the first tube has a larger external diameter than the internal diameter of the first tube.

Preferably, at least the central transverse hole of the second tube arranged at the outermost end of the first tube is designed as a radius hole (a blind hole ending in the axial hole thereof).

The central transverse holes of the other second tubes are through holes if the other second tubes also have a larger external diameter than the internal diameter of the first tube. Provided that the external diameters of the other second tubes are smaller than the internal diameter of the first tube, it is sufficient to design the central transverse hole as a radius hole. According to the invention, the gassing agitator may have 2 to 8 second tubes, i.e. 4 to 16 agitator arms. Preferably, the agitator arms are arranged at right angles to one another. However, it is also possible to arrange the agitator arms in a star-shaped manner at smaller angles to one another, according to the number of agitator arms.

If more than 2 second tubes, i.e. more than 4 agitator arms are used, the second tubes are preferably of different lengths, in pairs. It is particularly preferred for the second tubes arranged at the outermost end to be of a shorter length than those lying further away.

BRIEF DESCRIPTION OF THE DRAWINGS

The invention will now be explained in greater detail with reference to the accompanying drawings, wherein:

Referring now more specifically to the drawings, FIG. 1 shows a first tube as the agitator shaft 1 which may be 1,000 mm in length, for example, with an external diameter of 60 mm, for example, and an inner hole 2 of 10 mm, for example. The agitator shaft 1 has two holes 3 and 4 arranged at an angle to its axis, at a distance of 35 and 70 mm respectively from the end of the tube. The diameter of the holes 3 and 4 is 18 mm, for example. The tube 1 may be produced in such a manner that ceramic powder is worked to a paste with organic binders in a manner which is known in itself, from which a tube is produced by extrusion. The tube is mainly machined after the presintering without great expense. Then the sintering takes place at temperatures in excess of 1,200° C. After that, only the holes 3 and 4 and the surfaces 5 and 6 are machined at the upper end of the tube 1, which is preferably fixed to the drive shaft 9 by means of a split clamping ring 7 and a union nut 8 to form the agitator shaft. Preferably, the surface 5 on which the clamping ring 7 engages is slightly conical. The end face 6 of the agitator shaft 1 is sealed with respect to the drive shaft 9 by means of suitable seals. By way of example, a copper ring 10 is illustrated on the left side or alternatively a ceramic paper disc 11.

Figure 1:
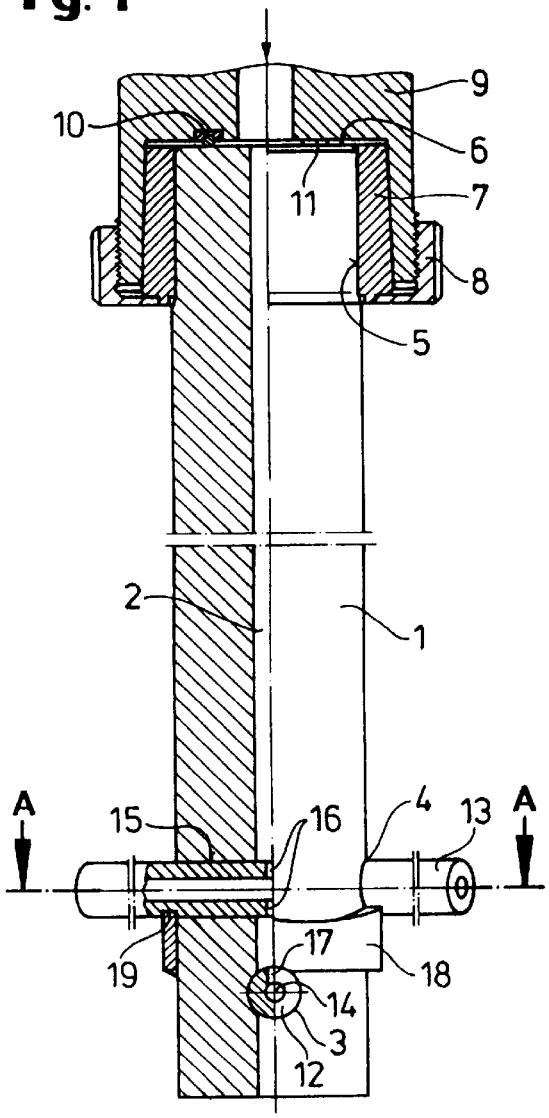
FIG. 1 is a partial vertical section of a first embodiment of a gassing agitator in accordance with the present invention.

If the tube 1 is produced by isostatic pressing (powder pressing), the main machining is carried out on the unfinished body, optionally after the pre-sintering. After the main sintering, only the critical surfaces are finish machined.

The agitator arm tubes 12 and 13 have, for example, an external diameter of approximately 18 mm and an internal diameter of approximately 7 mm. The length can be 200 mm. In the unfinished body state or after the pre-sintering, these are lightly turned at outer ends which project from the hole through the agitator shaft so that they can be easily pushed into the holes 3 or 4. The central transverse holes 16 and 17 are also produced and the tube ends are optionally cut off obliquely.

After the main sintering, only the central peripheral surface 15 is reworked to fit the transverse holes of the agitator shaft.

The locking takes place by means of a ceramic clamping ring 18 which, after locking, engages in the grooves 19 provided-on the transverse tubes 12 and 13. The holes 17 in the transverse tube 12 arranged at the outermost end of the agitator shaft 1 is designed as radius hole and the hole 16 in the transverse tube 13 further away from the end is designed as a through hole.

Figure 2:
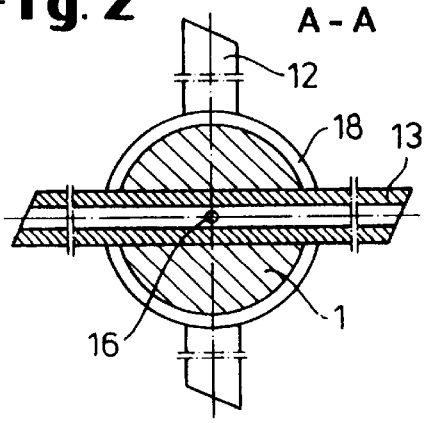
FIG. 2 is a section along line A—A of FIG. 1.

FIG. 2 shows a section A—A through the gassing agitator of FIG. 1.

Figure 3:
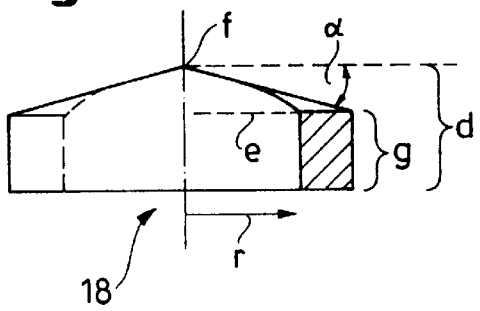
FIG. 3 is a partial sectional view of the clamping ring of FIG. 1 on a vertically exaggerated scale.

FIG. 3 shows an enlarged and vertically exaggerated illustration of the clamping ring 18, wherein the front right quarter of the ring is cut away. The clamping ring 18 may be produced as follows:

First a ring is produced with an internal radius r of 61 mm, for example, an external diameter of 80 mm and with a dimension in the axial direction d of 20 mm, for example. Then the ring is bevelled by an angle alpha on both sides over a diameter f perpendicular to the plane of the drawing with the result that the length of the surface line g at the piercing point of a radius perpendicular to the diameter f is still 15 mm. After that, the upper side of the ring obtained by the bevelling is machined such that each plane containing the ring axis forms a horizontal line of intersection with the upper side of the ring. Only the final machining stage takes place in the finished fired state.

The gassing agitator is then assembled as follows:

First the tube 13 is pushed into the tube 1. Then the ring 18 is pushed on from the outermost end of the tube 1 so that the shortest surface line thereof engages in the groove 19. Then the tube 12 is pushed into the tube 1 and the ring 18 is turned until it also engages and locks in the groove of the ring 12. The locking element according to the invention as shown in the embodiment of the invention according to FIGS. 1 to 3 therefore consists of the clamping ring 18 and the grooves 19 arranged on the agitator arms outside the radius of the agitator shaft.

Figure 4:
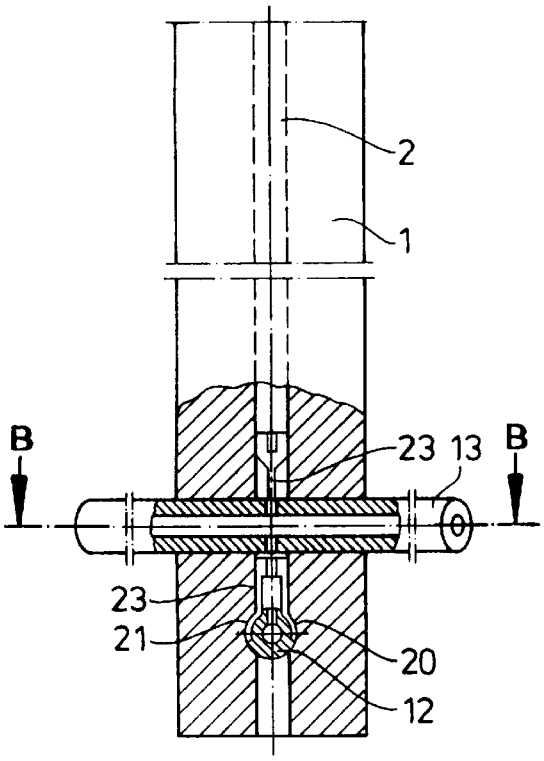
FIG. 4 is a partial sectional view of a gassing agitator with an alternative locking element.
Figure 5:
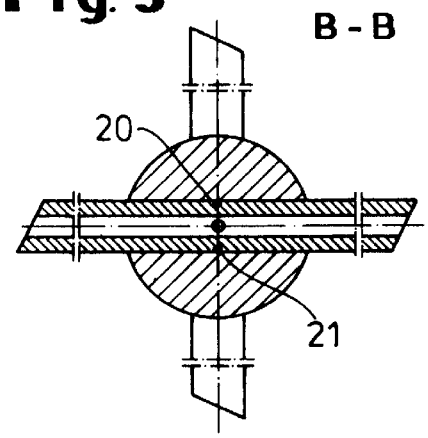
FIG. 5 is a section taken along line B—B of FIG. 4.
Figure 6:
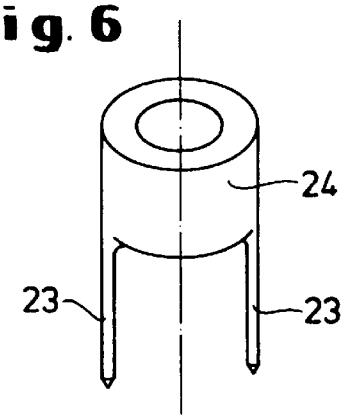
FIG. 6 is a perspective view of the locking element of FIG. 4.

FIGS. 4, 5 and 6 show a further embodiment of the locking element according to the invention. Here, the agitator arm tubes 12 and 13 are provided on one or both sides of the central hole with grooves 20 and/or 21 extending partly over the periphery. A wire pin 23, e.g. a steel wire pin, which locks each agitator arm tube against the internal hole of the agitator shaft 1 is pushed into the grooves. Preferably, the steel wire 23 is designed in the form of a 180°-bend so that the two ends of the bend may be pressed into the grooves 20 and 21 of an agitator arm tube. A particularly preferred embodiment of the locking element according to the invention is illustrated in FIG. 6. This consists of a cylindrical sleeve 24 which has parallel-axis pins 23 at one end. Such a locking element according to FIG. 6 may, after an agitator arm tube has been pushed into the hole of the agitator shaft 1, be introduced in a simple manner into the hole 2 of the agitator shaft I and pressed into the grooves 20 and 21 by means of a rod introduced into the hole 2.

Figure 7:
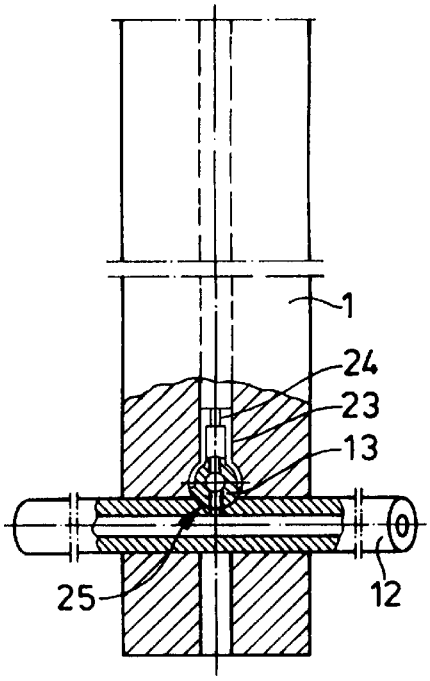
FIG. 7 is a partial sectional view of the gassing agitator with yet another locking element.

FIG. 7 shows a further locking option. According to FIG. 7, the transverse holes in the agitator shaft 1 are provided offset in the axial direction such that they overlap. The lower agitator arm tube 12 is then provided at the centre with a cylindrical transverse groove 25 which constitutes the overlapping region of the transverse holes of the cylinder axis. Then, for assembly, the agitator arm tube 12 provided with the cylindrical groove is first inserted into the hole of the agitator shaft 1 and is locked by then inserting the second agitator arm tube 13. The agitator arm tube 13 is fixed by means of a locking device according to FIG. 6. The overlapping transverse holes may be taken into account by conditionally weakening the agitator shaft, particularly if the external diameters of the agitator shaft 1 and the agitator arm tubes 12, 13 differ greatly.

Figure 8:
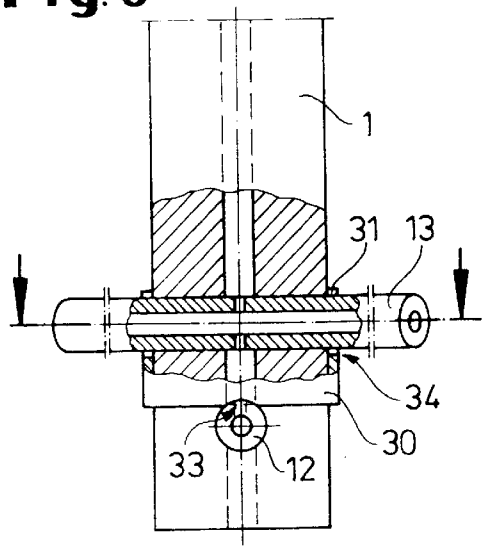
Figure 9:
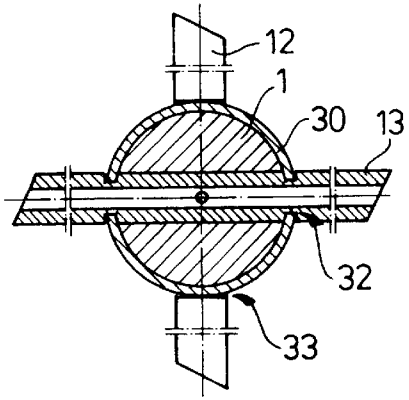

FIGS. 8 and 9 show a further locking device according to the invention. The locking element consists of a ceramic ring 30 which has parallel-axis slots 31 on one side which engage in grooves 32 in the agitator arm tube 13. The second agitator arm tube 12 also has grooves 33 in which the lower edge of the ring 30 engages after assembly. For assembly, the agitator arm tube 13 is first inserted into the agitator shaft tube 1, then the ring 30 is pushed in as far as the stop, then the tube 12 is pushed in and the ring 30 is inserted into the groove 33 of the tube 12. Here it is necessary for the grooves 31 to be lower than is necessary after assembly, i.e. for there to be a clearance 34 by which the ring 30 may be raised in order to release the groove 33.

Figure 10:
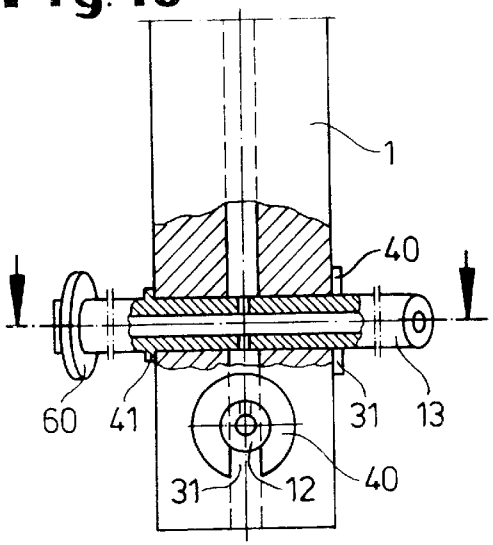
Figure 11:
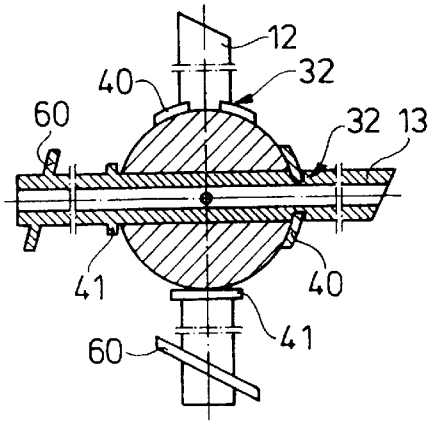

A further embodiment of the locking according to the invention is shown in FIGS. 10 and 11. Here, the agitator arm tubes 12 and 13 have on one side, at a distance equal to the radius of the agitator shaft 1 from the center, a bead 41 which was left after machining in the unfinished body state or after pre-sintering. The other end of the agitator arm tubes 12 and 13 is locked by means of grooves 32 provided therein and locking rings 14 pushed over the grooves, the locking rings 14 having a groove 31 encompassing the tubes 12 and 13. The locking rings 40 are produced from ceramic. In order to improve the gas distribution, it may also be provided for an outer end of the agitator arm tubes 12 and 13 to be equipped with a shear board 60 which is produced by machining in the unfinished body state or after the pre-sintering. When rotated in the melt, the shear board 60 produces eddies which serve better to distribute the gas introduced into the melt. Since, according to the invention, the shear board 60 cannot be attached on both sides of the agitator arm tubes, according to the invention it is preferred to compensate for the imbalance during rotation of the gassing agitator conditioned by the shear board 60 on one side in that the second agitator arm belonging to an agitator arm tube, which has no shear board 60, is correspondingly longer. In this context, "central" in the sense of the central transverse hole of the agitator arm tube is not intended to designate the geometric center, but rather the center with respect to the rotational speed resistance of the agitator arm in the melt.

Figure 12:
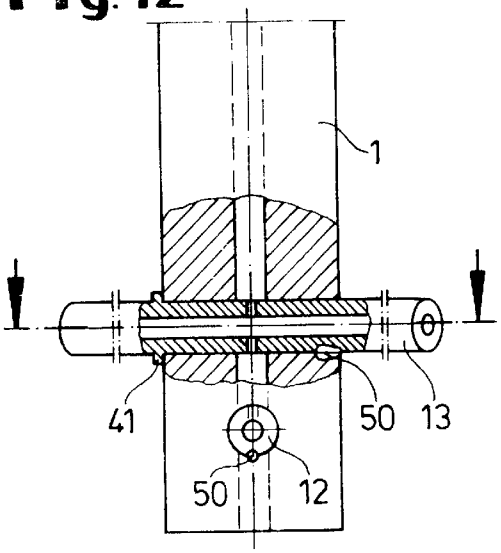
FIGS. 8 to 9,10 to 11 and 12 to 13 are pairs of partial vertical sections and transverse sections of further embodiments of locking devices.
Figure 13:
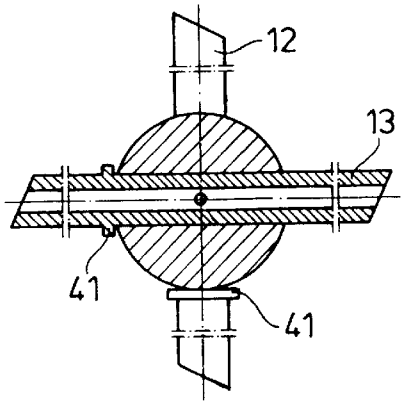

A further embodiment of the locking according to the invention is shown in FIGS. 12 and 13. Here, as well, a bead 41 is provided on one side, on a side on which the agitator arm tube exits from the hole in the agitator shaft. On the other side, a pocket 50, in the sense of an erosion of the volume of the ceramic mass, is created back at the unfinished body stage or after the pre-sintering of the tubes. After the tubes have been fitted together, the pocket 50 is filled with a ceramic cement. Such ceramic cements are available in the form of high temperature-resistant hydraulic or sinterable cements, e.g. based on calcium aluminate with a thermal resistance of up to 1,600° C. Due to the irregular, preferably undercut erosion of the volume 50, after hardening the hydraulic cement introduced into the volume 50 assumes a locking function, even if it does not bind to the ceramic. The positive closure provided by this spring element is sufficient for fixing.

According to a preferred embodiment of the locking according to FIGS. 12 and 13, the bead 41 may be omitted. It may also be provided for several cement locks 50 to be provided on an agitator arm tube.

Preferably, the agitator arm tubes have, outside the agitator shaft, one or more transverse holes as gas outlet holes, optionally of different diameters in order to compensate for the differing gas outlet pressures.

It will be understood that the specification and examples are illustrative but not limitative of the present invention and that other embodiments within the spirit and scope of the invention will suggest themselves to those skilled in the art.

We claim:

1. A gassing agitator for light metal melts comprising:

a) a first ceramic tube as an agitator shaft having, at one end, 2–8 opposite offset holes extending transversely to the tube axis;

b) 2–8 second ceramic tubes as agitator arms with an external diameter fitting said 2–8 holes of the first tube each itself having a hole centrally arranged transversely to its axis;

c) said second tubes each having a transverse hole arranged so that the centrally arranged transverse hole of the second tube communicates with the inside of the first tube;

d) said second tubes being fixed in said transverse holes of the first tube by a mechanical locking element to prevent axial displacement; and wherein e) should one of said second tubes be arranged at the outermost end of the first tube, said second tube has a larger external diameter than the internal diameter of the first tube.

2. A gassing agitator according to claim 1, wherein at least the central transverse hole of the second tube provided at the outermost end of the first tube is designed as a radius hole.

* * * * *